US006131542A

United States Patent [19]

Suckewer et al.

[11] Patent Number: 6,131,542

[45] **Date of Patent: *Oct. 17, 2000**

[54] HIGH EFFICIENCY TRAVELING SPARK IGNITION SYSTEM AND IGNITOR THEREFOR

[75] Inventors: Szymon Suckewer; Enoch J. Durbin, both of Princeton, N.J.

[73] Assignee: Knite, Inc., Princeton, N.J.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/204,440

[22] Filed: Dec. 2, 1998

Related U.S. Application Data

[63] Continuation-in-part of application No. 09/194,167, filed as application No. PCT/US97/09240, May 29, 1997, which is a continuation of application No. 08/730,685, Oct. 11, 1996, Pat. No. 5,704,321.

[60] Provisional application No. 60/018,534, May 29, 1996.

[51] Int. Cl.[7] ..... F02P 23/00

[52] U.S. Cl. ..... 123/143 B

[58] Field of Search ..... 123/143 B, 143 R, 123/146.5 R

[56] References Cited

U.S. PATENT DOCUMENTS

| | | | |
|---|---|---|---|
| 3,413,518 | 12/1968 | Chafer et al. | 315/180 |
| 3,842,819 | 10/1974 | Atkins et al. | 123/169 |
| 4,122,816 | 10/1978 | Fitzgerald et al. | 123/148 |

(List continued on next page.)

FOREIGN PATENT DOCUMENTS

| | | | |
|---|---|---|---|
| WO88/04729 | 6/1988 | WIPO | 4/3 |
| WO91/15677 | 10/1991 | WIPO | 5/9 |
| WO93/10348 | 5/1993 | WIPO | 5/9 |

OTHER PUBLICATIONS

R.D. Matthews et al., "Further Analysis of Railplugs as a New Type of Ignitor", *SAE* 922167 (1992), pp. 1851–1862.

R.M. Clements et al., "An Experimental Study of the Ejection Mechanism for Typical Plasma Jet Igniters", *Combustion and Flame* 42:287–295 (1981).

Rudolf Maly, "Ignition Model for Spark Discharges and the Early Phase of Flame Front Growth", Rudolf Maly, "Ignition Model for Spark Discharges and the Early Phase of Flame Front Growth", *Eighteenth Symposium (International) on Combustion*, pp. 1747–1754, The Combustion Institute, 1981.

Ather A. Quader, "How Injector, Engine, and Fuel Variables Impact Smoke and Hydrocarbon Emissions with Port Fuel Injection", *Society of Automotive Engineers, Inc.*, pp. 1–23, Copyright 1989 No. 89062.

D. Bradley and I.L. Critchley, "Electromagnetically Induced Motion of Spark Ignition Kernels", *Combustion and Flame* 22, 143–152 (1974).

(List continued on next page.)

*Primary Examiner*—Henry C. Yuen
*Assistant Examiner*—Hieu T. Vo
*Attorney, Agent, or Firm*—Wolf, Greenfield & Sacks, P.C.

[57] ABSTRACT

An high efficiency low energy ignitor and associated electrical systems for creating larger plasma ignition kernels to ignite a gaseous mixture of air fuel in a combustion engine is described. The apparatus has at least two spaced apart electrodes having a discharge gap between them. When a sufficiently high first potential is applied between the electrodes a plasma is formed from the air fuel. The volume of this plasma is increased by the application of a second voltage that creates a current through the plasma. The location where the current travels through the plasma is swept outward along with the plasma, due to the interaction of Lorentz and thermal expansion forces. This leads to a larger volume of plasma being created and thereby increases the efficiency of the burn cycle of the combustion engine. Also described are dimensioning characteristics related to the electrodes and the space between them that achieve optimal plasma formation and expulsion.

26 Claims, 7 Drawing Sheets

U.S. PATENT DOCUMENTS

| | | | |
|---|---|---|---|
| 4,366,801 | 1/1983 | Endo et al. | 123/620 |
| 4,369,756 | 1/1983 | Ezoe | 123/620 |
| 4,369,758 | 1/1983 | Endo | 123/620 |
| 4,398,526 | 8/1983 | Hamai et al. | 123/606 |
| 4,418,660 | 12/1983 | Endo et al. | 123/143 |
| 4,433,669 | 2/1984 | Ishikawa et al. | 123/620 |
| 4,448,181 | 5/1984 | Ishikawa et al. | 123/620 |
| 4,455,989 | 6/1984 | Endo et al. | 123/620 |
| 4,487,177 | 12/1984 | Ishikawa | 123/260 |
| 4,487,192 | 12/1984 | Anderson et al. | 123/654 |
| 4,677,960 | 7/1987 | Ward | 123/598 |
| 4,774,914 | 10/1988 | Ward | 123/162 |
| 4,805,570 | 2/1989 | Davis | 123/310 |
| 4,841,925 | 6/1989 | Ward | 123/143 |
| 4,930,473 | 6/1990 | Dietrich | 282/74 |
| 4,996,967 | 3/1991 | Rosswurm et al. | 123/598 |
| 5,007,389 | 4/1991 | Kashiwara et al. | 123/169 |
| 5,076,223 | 12/1991 | Harden et al. | 123/143 |
| 5,131,376 | 7/1992 | Ward et al. | 684/595 |
| 5,197,448 | 3/1993 | Porreca et al. | 123/620 |
| 5,207,208 | 5/1993 | Ward | 123/596 |
| 5,211,142 | 5/1993 | Matthews et al. | 123/143 |
| 5,215,066 | 6/1993 | Narishige et al. | 123/620 |
| 5,228,425 | 7/1993 | Simons | 123/620 |
| 5,377,633 | 1/1995 | Wakeman | 123/297 |
| 5,423,306 | 6/1995 | Trigger et al. | 123/637 |
| 5,456,241 | 10/1995 | Ward | 173/598 |
| 5,517,961 | 5/1996 | Ward | 123/307 |
| 5,555,862 | 9/1996 | Tozzi | 123/143 B |
| 5,619,959 | 4/1997 | Tozzi | 123/143 B |
| 5,704,321 | 1/1998 | Suckewer et al. | 123/143 B |

OTHER PUBLICATIONS

M.J. Hall et al., "Initial Studies of a New Type of Ignitor: The Railplug", SAE 1991 Transactions/SAE Paper 912319, pp. 1730–1746, vol. 100, No. 3 (1991).

SAE Technical Paper Series, 940150, "Performance Improvement From Dual Energy Ignition On A Methanol Injected Cosworth Engine," International Congress & Exposition, Detroit, Michigan, Feb. 28—Mar. 3, 1994.

HIGH EFFICIENCY TRAVELING SPARK IGNITION SYSTEM AND IGNITOR THEREFOR

This application is a continuation-in-part of application Ser. No. 09/194,167 filed Mar. 8, 1999 which is a 371 of PCT/US97/09,240 having an international filing date of May 29, 1997 and a priority date of May 29, 1996 which is a continuation of Ser. No. 08/730,685, filed Oct. 11, 1996, now U.S. Pat. No. 5,704,321 which claims priority under 35 U.S.C. §119(e) to provisional patent application Ser. No. 60/018,534 filed May 29, 1996 and now abandoned.

FIELD OF THE INVENTION

This invention relates generally to internal combustion engine ignition systems, including the associated firing circuitry and ignitors. More particularly the invention relates to high efficiency traveling spark ignitor and associated firing circuitry.

BACKGROUND OF THE INVENTION

Automobiles have undergone many changes since their initial development at the end of the last century. Many of these evolutionary changes can be seen as a maturing of technology, with the fundamental principles remaining the same. Such is the case with the ignition system. Some of its developments include the replacement of mechanical distributors by electronic ones, increasing reliability and allowing for easy adjustment of the spark timing under different engine operating conditions. The electronics responsible for creating the high voltage required for the discharge have changed, with transistorized coil ignition (TCI) and capacitive discharge ignition (CDI) systems common today. However, the basic spark plug structure has not changed.

The need for an enhanced ignition source has long been recognized. Many inventions have been made which provide enlarged ignition kernels. To this end, the use of plasma jets and Lorentz force plasma accelerators have been the subject of much study. A significant primary weakness of the prior inventions has been the requirement for excessive ignition energy, which eliminates the possible efficiency enhancement in the engine in which they are employed.

A spark driven by the force from the interaction of the magnetic field created by the spark current and the current itself is a very attractive concept for enlarging the ignition kernel for a given ignition system input energy. The concept of enlarging the volume and surface area of the spark-initiated plasma ignition kernel is an attractive idea for extending the practical lean limit for combustible mixtures in a combustion engine. An objective is to reduce the variance in combustion delay which is typical when engines are operated with lean mixtures. More specifically, there has been a long-felt need to eliminate ignition delay, by increasing the spark volume. While it will be explained in more detail below, note that if a plasma is confined to the space between the discharge electrodes (as is the case with a conventional spark plug), its initial volume is quite small; typically about 1 $mm^3$ of plasma having a temperature of 60,000° K. is formed. This kernel expands and cools to a volume of about 25 $mm^3$ and a temperature of 2,500° K., which can ignite the combustible mixture. This volume represents about 0.04% of the mixture that is to be burned to complete combustion in a 0.5 liter cylinder at a compression ratio of 8:1. Front the discussion below it will be seen that if the ignition kernel could be increased 100 times, 4% of the combustible mixture would be ignited and the ignition delay would be significantly reduced.

The electrical energy required in these earlier systems, e.g., Fitzgerald et al., U.S. Pat. No. 4,122,816, is claimed to be more than two Joules per firing (col. 2, lines 55–63). This energy is about forty times higher than that used in conventional spark plugs.

Matthews et al., infra, reports the use of 5.5 Joules of electrical energy per ignition, or more than one hundred times the energy used in conventional ignition systems.

Consider a six cylinder engine operating at 3600 RPM, which requires firing three cylinders every engine revolution or 180 firings per second. At two Joules per firing this is 360 Joules/second. This energy must be provided by the combustion engine at a typical efficiency of about 18% and converted to a suitable higher voltage by power conversion devices with a typical efficiency of about forty percent for a net use of the engine fuel at an efficiency of about 7.2%. Fitzgerald requires a fuel consumption of 360/0.072 Joules/second, or about 5000 Joules/second to run the ignition system.

To move a 1250 kg vehicle on a level road at about 80 km/hr (about 50 mph) requires about 9000 Joules/second of fuel energy. At an engine, fuel to motive force conversion efficiency of 18%, about 50,000 Joules/second of fuel will be consumed. Thus, the system employed by Fitzgerald et al, infra, will consume about 10% of the fuel energy consumed to run the vehicle to run the ignition system. This is greater than the efficiency gain to be expected by use of the Fitzgerald et al. ignition systems.

By comparison, conventional ignition systems use about 0.25 percent of the fuel energy to run the ignition system. Further, the high energy employed in these systems causes high levels of erosion to occur in the electrodes of the spark plugs, thus reducing the useful operating life considerably. This shortened life is demonstrated in the work by Matthews et al., infra, where the need to reduce ignition energy is acknowledged although no solution is provided.

As an additional attempt at solving this problem, Tsao and Durbin report (Tsao, L. and Durbin, E. J., "Evaluation of Cyclic Variation and Lean Operation in a Combustion Engine with a Multi-Electrode Spark Ignition System", *Princeton Univ., MAE Report,* (January, 1984)) that a larger than regular ignition kernel was generated by a multiple electrode spark plug, demonstrating a reduction in cyclic variability of combustion, a reduction in spark advance, and an increase in output power. The increase in kernel size was only six times that of an ordinary spark plug.

Bradley and Critchley (Bradley, D., Critchley, I. L., "Electromagnetically Induced Motion of Spark Ignition Kernels", *Combust. Flame* 22, pgs. 143–152 (1974)) were the first to consider the use of electromagnetic forces to induce a motion of the spark, with an ignition energy of twelve Joules. Fitzgerald (Fitzgerald, D. J., "Pulsed Plasma Ignitor for Internal Combustion Engines", *SAE paper* 760764 (1976); and Fitzgerald, D. J., Breshears, R. R., "Plasma Ignitor for Internal Combustion Engine", U.S. Pat. No. 4,122,816 (1978)) proposed to use pulsed plasma thrusters for the ignition of automotive engines with much less but still substantial ignition energy (approximately 1.6 J). Although the lean limit was extended, the overall performance of such plasma thrusters used for ignition systems was not significantly better than that of regular spark plugs. In this system, much more ignition energy was used without a significant increase in plasma kernel size. (Clements, R. M., Smy, P. R., Dale, J. D., "An Experimental Study of the Ejection Mechanism for Typical Plasma Jet Ignitors", *Combust. Flame* 42, pages 287–295 (1981)). More recently Hall et al. (Hall, M. J., Tajima, H., Matthews, R. D., Koeroghlian, M. M., Weldon, W. F., Nichols, S. P., "Initial Studies of a New Type of Ignitor: The Railplug", *SAE paper* 912319 (1991)), and Matthews et al. (Matthews, R. D., Hall, M. J., Faidley, R. W., Chiu, J. P., Zhao, X. W., Annezer, I., Koening, M. H., Harber, J. F., Darden, M. H., Weldon, W. F., Nichols, S. P., "Further Analysis of Railplugs as a New Type of Ignitor", *SAE paper* 922167 (1992)), have shown that a "rail plug" operated at an energy of over 6 J (2.4 cm long) showed a very substantial improvement in combustion bomb experiments. They also observed improvements in the lean operation of an engine when they ran it with their spark plug at an ignition energy of 5.5 J. They attributed the need of this excessive amount of energy to poor matching between the electrical circuit and the spark plug. This level of energy expended in the spark plug is about 25% of the energy consumed in propelling a 1250 kg vehicle at 80 km/hr on a level road. Any efficiency benefits in engine performance would be more than consumed by the increased energy in the ignition system.

SUMMARY OF THE INVENTION

With the problems of the prior art in mind, an object of the invention is to provide a more efficient and high performance apparatus for creating increased plasma volumes requiring a low amount of input energy. The present invention accomplishes this by providing an ignitor and associated circuitry that requires a small amount of input energy and is dimensioned and configured such that both Lorentz and thermal expansion forces serve to create an enlarged plasma kernel and to expel the plasma kernel deep into a combustion chamber of an engine.

In one aspect of the invention a high efficiency plasma ignitor for an internal combustion engine having a combustion cylinder and means for delivering fuel to the combustion cylinder is disclosed. The ignitor includes at least two spaced apart electrodes, including at least a first electrode and a second electrode having a discharge gap between them, the first and second electrode having a first length and a second length, respectively. Also included is dielectric material filling a substantial portion, but not all, of the discharge gap between the first and second electrodes. The electrodes are dimensioned and configured and their spacing is arranged such that when a sufficiently high first voltage is applied across the electrodes in a gaseous mixture of air and fuel in the combustion cylinder of the engine a plasma is generated from the gaseous mixture of air and fuel in the discharge gap, and the plasma moves outwardly into the cylinder under both a thermal expansion force and a Lorentz force.

In another aspect, the ratio of a width of the discharge gap to the length of one of the electrodes is greater than about one-third.

In another aspect, the first and second electrodes are concentric parallel cylinders and have a first and second radius, respectively.

In another aspect the ratio of the sum of radii of the electrodes to the length of one of the electrodes is greater than about one-third and less than about six and one-third.

In another aspect the ratio of the sum of radii of the electrodes to the length of one of the electrodes is greater than about two and less than about five.

Another aspect provides mounting means matable with co-acting mounting means in the combustion cylinder of the engine, such that the discharge gap of the plasma ignitor is disposed in the combustion cylinder when the ignitor mounting means are mated to the combustion cylinder's mounting means.

In yet another aspect, a third electrode located between the first and second concentric electrodes.

In another aspect, the lengths of the first and second electrodes are of the form of annular sections of disks oriented in a plane perpendicular to a longitudinal axis of the plasma ignitor.

In another aspect, the gaseous mixture of air and fuel is provided to the combustion cylinder of an engine by direct fuel injection.

In one aspect, the first and second electrodes are spaced apart parallel electrodes, each having a radius.

In another aspect, a third electrode is located between the first and second spaced apart parallel electrodes.

In another aspect of the invention, the ignitor is part of system that includes electrical means for alternately providing a first and second potential difference between the first and second electrodes, the first potential difference creating a plasma in the unfilled portion of the discharge gap, the second potential sustaining a current through the plasma in the unfilled portion of the discharge gap, whereby a magnetic field from the current interacts with an electric field from the potential difference between the electrodes causing the plasma to be expelled from the discharge gap under both a Lorentz force and a thermal expansion force due to the creation of the plasma.

A number of aspects of the invention have been summarized above. It should be understood that the aspects are not neccessarily inclusive or exclusive of each other and may be combined in any manner that is non-conflicting and otherwise possible. Thus, it is possible that the aspects described above may be present singly or in combination. It should also be understood that these aspects of the invention are exemplary only and are considered to be non-limiting. Further aspects of the present invention as well as the structure and operation of various aspects are described in detail below with reference to the accompanying drawings.

BRIEF DESCRIPTION OF THE DRAWINGS

Various exemplary embodiments of devices according to the invention are illustrated and described below with reference to the accompanying drawings, in which like items are identified by the same reference designation, wherein.

DETAILED DESCRIPTION

A traveling spark initiator or ignitor (TSI) according to the invention achieves a high efficiency transfer of electrical energy into plasma volume creation. The present TSI and associated circuitry achieve enhanced plasma volume and expel the plasma deeper into a combustible mixture than conventional ignition systems. These improvements are achieved by configuring the TSI, and matching its associated circuitry, such that thermal and electromagnetic forces combine to create an optimal expulsion of a larger plasma ignition kernel produced herein.

Figure 1:
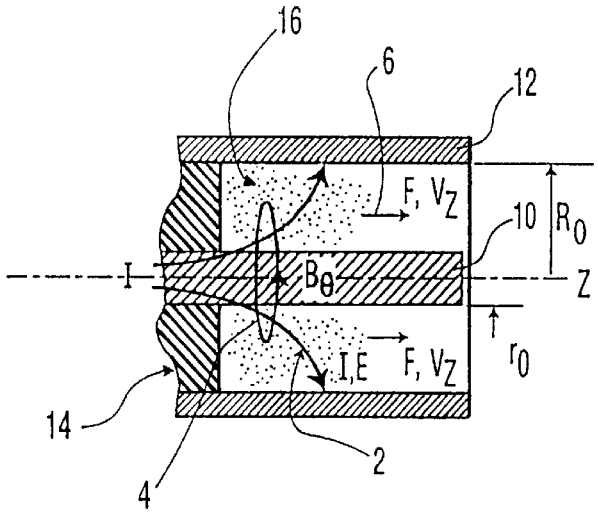
FIG. 1 (PRIOR ART)
FIG. 1 is a cross-sectional view of a cylindrical Marshall gun with a pictorial illustration of its operation, which is useful in understanding the invention.

FIG. 1 shows a prior art Marshall gun. The principle of the Marshall gun presents an effective way of creating a large volume of plasma. The schematic presentation in FIG. 1 shows the electric field 2 and magnetic field 4 in an illustrative coaxial plasma gun, where $B_0$ is the polar magnetic field directed along field line 4. The plasma 16 is moved in a direction 6 by the action of the Lorentz force vector F and thermal expansion, with new plasma being continually created by the breakdown of fresh gas as the discharge continues. $V_z$ is the plasma kernel speed vector, also directed in the z-direction represented by arrow 6. Thus, the plasma 16 grows as it moves along and through the spaces between electrodes 10, 12 (which are maintained in a spaced relationship by isolator or dielectric 14). Once the plasma 16 leaves the electrodes 10, 12, it expands in volume, cooling in the process. It ignites the combustible mixture after it has cooled to the ignition temperature. Fortunately, increasing plasma volume is consistent with acknowledged strategies for reducing emissions and improving fuel economy. Two such strategies are to increase the dilution of the gas mixture inside the cylinder and to reduce the cycle-to-cycle variation in combustion.

Dilution of the gas mixture, which is most commonly achieved by the use of either excess air (i.e., running the engine lean) or exhaust gas recirculation (EGR), reduces the formation of oxides of nitrogen by lowering the combustion temperature. Oxides of nitrogen play a critical role in the formation of smog, and their reduction is one of the continuing challenges for the automotive industry. Dilution of the gas mixture also increases the fuel efficiency by lowering temperature and thus reducing the heat loss through the combustion chamber walls, improving the ratio of specific heats; and by lowering the pumping losses at a partial load.

Zeilinger determined the nitrogen oxide formation per horsepower-hour of work done, as a function of the air-to-fuel ratio, for three different spark timings (Zeilinger, K., Ph.D. thesis, Technical University of Munich (1974)). He found that both the air-to-fuel ratio and the spark timing affect the combustion temperature, and thus the nitrogen oxide formation. As the combustible mixture or air-to-fuel ratio (A/F) is diluted with excess air (i.e., A/F larger than stoichiometric), the temperature drops. At first, this effect is diminished by the increase in the amount of oxygen which causes $NO_x$ formation to increase. When the mixture is further diluted, the $NO_x$ formation decreases to values much below those at a stoichiometric mixture because the combustion temperature decline overwhelms the increase in $O_2$.

A more advanced spark timing (i.e., initiating ignition more degrees before top dead center) raises the peak temperature and decreases engine efficiency because a larger fraction of the combustible mixture burns before the piston reaches top dead center (TDC) and the mixture is compressed to a higher temperature, hence leading to much higher $NO_x$ levels and heat losses. As the mixture is made lean, the spark timing which gives the maximum brake torque (MBT timing) increases.

Dilution of the mixture results in a reduction of the energy density and the flame propagation speed, which affect ignition and combustion. The lower energy density reduces the heat released from the chemical reaction within a given volume, and thus shifts the balance between the chemical heat release and the heat lost to the surrounding gas. If the heat release is less than that lost, the flame will not propagate. An increase in the ignition volume is required to assure that the flame propagation does not slow down as the energy density of the combustible mixture is reduced.

Reducing the flame propagation speed increases the combustion duration. Ignition delay results from the fact that the flame front is very small in the beginning, which causes it to grow very slowly, as the quantity of air-fuel mixture ignited is proportional to the surface area. The increase in the ignition delay and the combustion duration results in an increase of the spark advance required for achieving the maximum torque, and reduces the amount of output work available. A larger ignition kernel will reduce the advance in spark timing required, and thus lessen the adverse effects associated with such an advance. (These adverse effects are an increased difficulty to ignite the combustible mixture, due to the lower density and temperature at the time of the spark, and an increase in the variation of the ignition delay, which causes engine performance over varying operating conditions to deteriorate).

Cyclic variations are caused by unavoidable variations in the local air-to-fuel ratio, temperature, amount of residual gas, and turbulence. The effect of these variations on the cylinder pressure is due largely to their impact on the initial expansion velocity of the flame. This impact can be significantly reduced by providing a spark volume which is appreciably larger than the mean sizes of the inhomogeneities.

A decrease in the cyclic variations of the engine conditions will reduce emissions and increase efficiency, by reducing the number of poor burn cycles, and by extending the operating air/fuel ratio range of the engine. This ignition capability is particularly important in difficult combustion environments such as in engines using stratified-charge fueling, direct fuel injection (DFI), exhaust-gas recirculation (EGR), or alchol-based fuels. For example, in systems using DFI the air/fuel mixture is not always consistent due to the non-uniform droplets formed when injecting the fuel into the cylinder.

Quader determined the mass fraction of the combustible mixture which was burned as a function of the crank angle, for two different start timings (Quader, A., "What Limits Lean Operation in Spark Ignition Engines—Flame Initiation or Propagation?", *SAE Paper* 760760 (1976)). His engine was running very lean (i.e., an equivalence ratio of about 0.7), at 1200 rpm and at 60% throttle. The mass fraction burned did not change in any noticeable way immediately after the spark occurred (there is an interval where hardly any burning can be detected, commonly known as the ignition delay). This was due to the very small volume of the spark, and the slow combustion duration owing to the small surface area and relatively low temperature. Once a small percentage of the combustible mixture has burned, the combustion rate increases, slowly at first, and then more rapidly as the flame front grows. The performance of the engine at both of these spark timings is poor. In the case of 60° B.T.D.C. (before top dead center ignition timing), too much of the mixture has burned while the piston is compressing the mixture therefore, negative work is being done. The rise in pressure opposes the compression strokes of the engine. In the case of 40° B.T.D.C. timing, a considerable fraction of the mixture is burned after the expansion strokes have started, thus reducing the output work available.

The intersection of a 4% burned line with the curves determined by Quader, id., shows the potential advantage that a large spark volume, if it were available, would have in eliminating the ignition delay. For the 60° B.T.D.C. spark curve, if the spark timing is changed from 60° to 22° B.T.D.C., a change of nearly 40 degrees, the rate of change of mass fraction burned will be higher because the combustible mixture density will be higher at the moment of ignition. For the 40° B.T.D.C. spark time curve, if the timing is changed from 40° to 14° B.T.D.C., a change of about 25 degrees, the combustible mixture will be completely burned at a point closer to TDC, thus increasing efficiency.

The above clearly illustrates the importance of an increase in spark volume for reduced emission and improved fuel economy. With the TSI system disclosed herein the required spark advance for maximum efficiency can be reduced by 20° to 30°, or more.

While increasing spark volume, the present TSI system also provides for moving the spark deeper into the combustible mixture, with the effect of reducing the combustion duration.

To achieve these goals, the present invention uses a relatively short length of electrodes with a relatively large gap between them; that is, the gap is large relative to electrode length.

Figure 2:
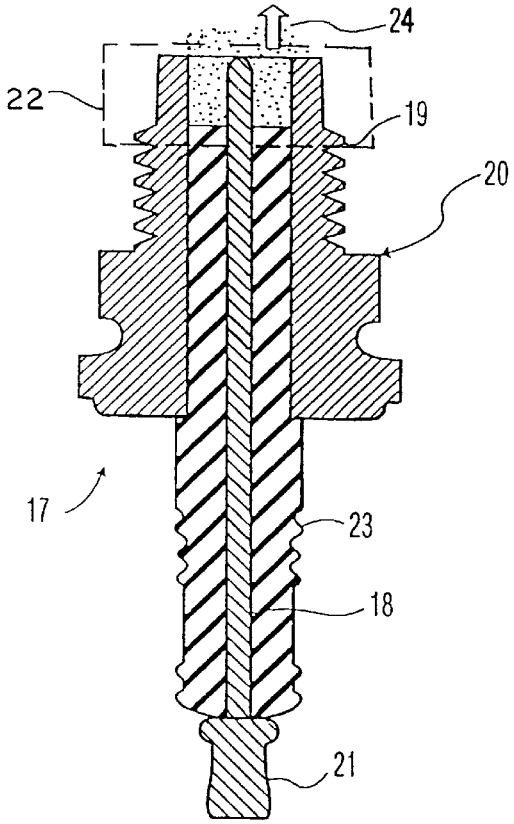
FIG. 2 is a cross-sectional view of a cylindrical traveling spark ignitor for one embodiment of this invention, taken through the axes of the cylinder, including two electrodes and wherein the plasma produced travels by expanding in the axial direction.

FIG. 2 illustrates one embodiment of a TSI 17 according to the present invention. This embodiment contains standard mounting means 19 such as threads for mounting the TSI 17 in a piston chamber. It also contains a standard male spark plug connector 21, and insulating material 23. The tip 22 of the TSI 17 varies greatly from a standard spark plug. This tip 22 has two electrodes, a first electrode 18 and a second electrode 20. The particular embodiment shown in FIG. 2 has the first electrode 18 coaxially displaced into the interior volume of the second electrode 20. The second electrode 20 is attached to a distal boot connector 21. The space between the electrodes is substantially filled with insulating material 23.

Application of a voltage to the TSI 17 between the first and second electrodes, 18 and 20, causes a discharge which starts along the surface of the insulating material 23. This discharge begins before a discharge between the first and second electrodes, 18 and 19, because the insulating material 23 requires a lower voltage to initiate a discharge than that required to initiate a discharge through a gas some distance away from the insulating material 23. This initial discharge creates an electric field which serves to ionize the gas (an air/fuel mixture) and thereby create a plasma 24. This plasma 24 is a good conductor and supports a current between the first electrode 18 and the second electrode 20 at a lower voltage than was required to form the plasma. The current through the plasma serves to ionize even more gas into a plasma. The resulting magnetic fields surrounding the electrodes and the current passing through the plasma (the spark channel) interact with the electric field created on the surface of the dielectric to produce a Lorentz force on the plasma. This force causes the point of origin and destination of electrical current through the plasma to move and, thus, creates a larger cross sectional area for the spark channel. Increasing the cross sectional area of the spark channel in turn causes an even greater volume of plasma to be created. This is in contrast to traditional spark ignition systems wherein the point of origin of the spark remains fixed. The Lorentz force created also serves to expel the plasma from the TSI 17. Also, thermal expansion of the plasma aids in this expulsion and is an important factor in the dimensioning characteristics described below in relation to FIG. 3.

Referring again to FIG. 2, the first and seconds electrodes, 18 and 19, may be made from materials which may include any suitable conductor such as steel, clad metals, platinum-plated steel (for erosion resistance or "performance engines"), copper, and high-temperature electrode metals such as molybdenum or tungsten, for example. The material may be of a metal having a controlled thermal expansion like Kovar (a trademark and product of Carpenter Technology Corp.) and coated with a material such as cuprous oxide so as to give good subsequent seals to glass or ceramics. Electrode materials may also be selected to reduce power consumption. For instance, thoriated tungsten could be used, as its slight radioactivity may help to pre-ionize the air between the electrodes, possibly reducing the required ignition voltage. Also, the electrodes may be made of high-Curie temperature permanent magnet materials, polarized to assist the Lorentz force in expelling the plasma.

The electrodes, except for a few millimeters at their ends, are separated by insulating material 23 which may be an isolator or insulating material which is a high temperature, electrical dielectric. This material should be a non-porcelain fired ceramic without glaze, as is used in conventional spark plugs, for example. Alternatively, it can be formed of refractory cement, a machinable glass-ceramic such as Macor (a trademark and product of Corning Glass Company), or molded alumina, stabilized zirconia or the like fired and sealed to the metal electrodes with a solder glass frit, for example. As above, the ceramic could also comprise a permanent magnet material such as barium feirite.

Figure 3:
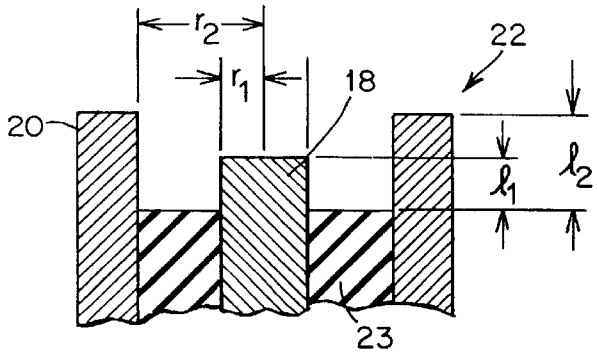
FIG. 3 is a detailed view of the tip of a cylindrical traveling spark ignitor for the embodiment shown in FIG. 2.

With reference to FIG. 3, a more detailed version of the tip 22 described in the embodiment of FIG. 2 is disclosed. The insulating material 23 fills substantially all of the space between the electrodes except for a short length of the electrodes which extends beyond the insulating material. The portion of the space between the electrodes is defined herein as the discharge gap. The discharge gap has both a length and a width. The length by which the first electrode 18 extends beyond the insulating material 23 is denoted herein as $l_1$ and the length by which the second electrode 20 extends beyond the insulating material is denoted as $l_2$. The first electrode 18 has a radius $r_1$ and the second electrode 20 has a radius $r_2$. The difference between the radii of the second and first electrodes, $r_2-r_1$, is defined herein as the width of the discharge gap. It should be noted however that the width of the discharge gap ($r_2-r_1$) may also be represented by the minimum distance between two spaced apart electrodes when the electrodes are not concentric.

The current through the central electrode 18 and the plasma 24 to the external electrode 20 creates around the central electrode 18 a polar (angular) magnetic field $B_0$ (I, r), which depends on the current and distance (radius $r_0$, see FIG. 1) from the axis of electrodes 18 and 20. Hence, the current I flowing through the plasma 24 perpendicular to the poloidal magnetic field $B_0$ generates a Lorentz force F on the charged particles in the plasma 24 along the axial direction z of the cylinders 18, 20. The force is computed as follows in equation (1):

$$F \sim I \times B \rightarrow F_z \sim I_r \cdot B_0 \quad (1)$$

This force accelerates the charged particles which, due to collisions with non-charged particles accelerate all the plasma. Note that the plasma consists of charged particles (electrons and ions), and neutral atoms. The temperature is not sufficiently high in the discharge gap to fully ionize all atoms.

The original Marshall guns as a source of plasma for fusion devices were operated in a vacuum with a short pulse of gas injection between the electrodes. The plasma created between the electrodes by the discharge of a capacitor was accelerated in a distance of a dozen centimeters to a final velocity of about $10^7$ cm/sec. The plasma gun used as an engine ignitor herein operates at relatively high gas (air/fuel mixture) pressure. The drag force $F_v$ of such a gas is approximately proportional to the square of the plasma velocity, as shown below in equation (2):

$$F_v \sim v_p^2 \quad (2)$$

The distance over which the plasma accelerates is short (e.g., 1–3 mm). Indeed, experimentation has shown that increasing the length of the plasma acceleration distance beyond 2 to 3 mm does not increase significantly the plasma exit velocity, although electrical energy used to drive such a TSI is increased significantly. At atmospheric pressures and for electrical input energy of about 300 mJ, the average velocity is close to $5\times10^4$ cm/sec and will be lower at high pressure in the engine. At a compression ratio of 8:1, this average velocity will be approximately $3\times10^4$ cm/sec.

By contrast, if more energy is put into a single discharge of a conventional spark, its intensity is increased somewhat, but the volume of the plasma created does not increase significantly. In a conventional spark, a much larger fraction of the energy input goes into heating the electrodes when the conductivity of the discharge path is increased.

Given the above dimensioning constraints, the present invention optimizes the combination of the electromagnetic (Lorentz) and thermal expansion forces when the TSI is configured according to the following approximate conditions:

$$\tfrac{1}{3} \leqq (r_2+r_1)/l_x \leqq 6\tfrac{1}{3} \quad (3)$$

$$(r_2-r_1)/l_x \geqq \tfrac{1}{3} \quad (4)$$

where $l_x$ is the length of either $l_1$ or $l_2$. It should be noted that the dimensional boundaries just expressed are approximate; small deviations above or below them still yield a functional TSI according to the present invention though probably with less than optimal performance. Also, as these dimensions define only the outer bounds, one skilled in the art would realize that there are many configurations which will satisfy these dimensional characteristics.

The quantity $(r_2-r_1)/l_x$ represents the gap-to-length ratio in this representation. This gap-to-length ratio is related to the volume within the TSI in which plasma is formed.

A smaller gap-to-length ratio increases the Lorentz force that drives the plasma out of the TSI. However, if the gap-to-length ratio becomes too small, the additional energy provided by the current, to which the Lorentz force is related—being proportional to the current squared—goes primarily into a breakdown of the electrodes because of erosion due to sputtering. Further, as described above, an optimally performing TSI should form a large volume plasma. Increasing the gap-to-length ratio increases the volume in which the plasma may be formed and, thereby, helps to increase the volume of plasma produced. Thus, the TSI of the present invention must have a sufficiently large gap-to-length ratio such that there is enough volume within which to form a plasma. This volume constraint also serves to set a lower limit for the gap-to-length ratio. A gap-to-length ratio of approximately ⅓ or more has been found to create an optimal balance between these two constraints.

Contrary to early attempts in which much of the input energy was lost in trying to accelerate the plasma against drag forces, which grow with the square of the velocity, having this large gap-to-length ratio provides for a larger volume of plasma production. The larger plasma volume is expelled at a lower velocity with a lower input energy.

The ratio $(r_2+r_1)/l_x$ represents the ratio of total electrode surface area of a TSI to the plasma (spark kernel) surface area generated. At least three practical design constraints weigh in favor of minimizing the total electrode surface area and thereby contribute to selecting the radii and the electrode lengths between the limits defined in equation 3 above.

First, a minimization of spark position variation helps to reduce the coefficient of variability (COV) for a high energy ignition system operating in a lean air/fuel mixture. A TSI generally reduces the COV by producing a larger ignition kernel, which ensures more consistent ignition of the air/fuel mixture. Another factor which affects the COV is the consistency of spark position within an engine cylinder. By minimizing the variation of spark position variations in the cylinder the cyclical variability of combustion is reduced and leads to greater engine performance, especially in direct fuel injection engines. In order to minimize the variation in spark position, and thereby reduce the COV, the total exposed electrode surface area should be kept to a minimum.

A second consideration is the inherent thermal expansion effect of creating a plasma. Along with the Lorentz force, the thermal expansion force helps to drive the plasma out of the TSI. Reducing the surface area helps to harness this thermal expansion energy because the less room the plasma has to expand within the TSI the sooner the plasma begins being forced out of the TSI. In order to achieve this, the total exposed electrode surface area should be reduced.

Another factor is the insulator surface temperature. When a ISI according to the present invention is run in a fuel/air mixture (especially when the fuel is gasoline) the surface temperature of the insulating material 23 between the electrodes 18 and 20 is important to resist the accumulation of carbon on the insulator. Eventually, if too much carbon accumulates on the insulator the TSI will not work efficiently because the electromagnetic forces produced in the insulating; material 23 will by affected by these carbon deposits. The colder the surface of the dielectric material 23, the more vulnerable it is to the accumulation of carbon. A high electrode surface area leads to a colder dielectric. Thus, in order to keep the dielectric at a higher temperature to reduce the effects of carbon accumulation, the total exposed electrode surface area should be minimized.

Given the above design considerations, the lower boundary of the electrode surface area below which the TSI does not perform in an efficient manner has been found to require that the ratio $(r_2+r_1)/l_x$ be greater than or equal to about ⅓. However, if the ratio of $(r_2+r_1)/l_x$ is greater or equal to about 6.33, the TSI is not able to take advantage of the combination of the electro-magnetic and thermal expansion forces described above.

The ranges of the ratios defined in equations 3 and 4 above allow for a broad functional range of the TSI of the present invention so as to allow it to perform in dramatically different operational conditions in varying engines. These ranges also allow for variations in materials available for construction and variations in dual-energy ignition electronics. Experiments have shown that the efficiency of a TSI of the present invention is optimized when the lower boundary of equation (3) is equal to about 2 and the upper boundary is equal to about 5.

Preferably, the TSI ignition system of the present invention uses no more than about 400 mJ per firing. By contrast, early plasma and Marshall gun ignitors have not achieved practical utility because they employed much larger ignition energies (e.g., 2–10 Joules per firing), which caused rapid erosion of the ignitor. Further efficiency gains in engine performance were surrendered by increased ignition system energy consumption.

The configuration shown in FIG. 3 is only one of many exemplary embodiments to which the dimensional characteristics of equations 3 and 4 may be applied. A particular embodiment found to be very successful has been built to the following specifications. The first electrode 18 has a length ($l_1$) of about 1.68 mm and a radius ($r_1$) of about 1.6 mm. The second electrode 20 has a length ($l_2$) of about 1.17 mm and a radius ($r_2$) of about 3.86 mm. The TSI requires approximately 330 mJ when operating in a gaseous mixture of natural gas and air.

Figure 4:
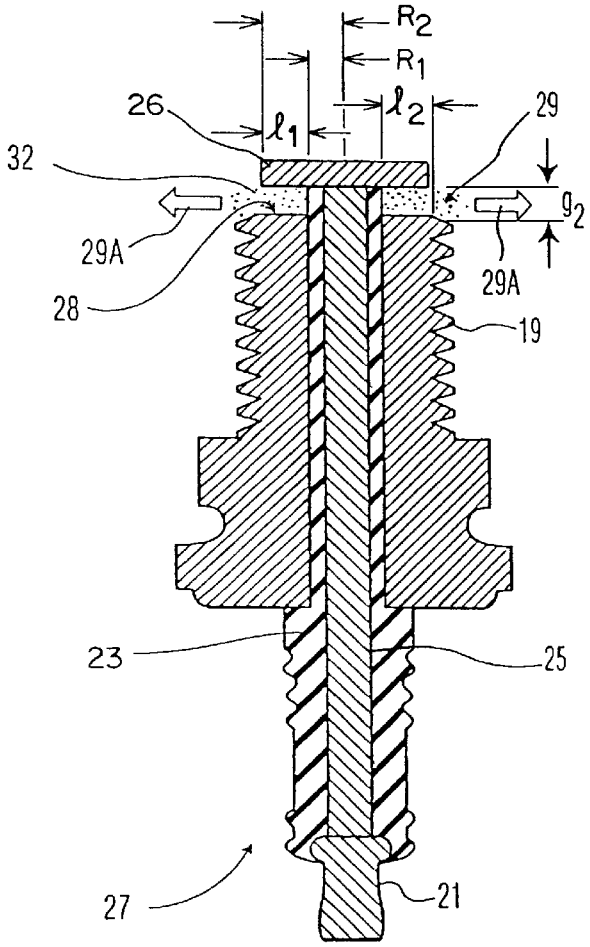
FIG. 4 is a cross-sectional view of a traveling spark ignitor for another embodiment of the invention wherein the plasma produced travels by expanding in the radial direction.

FIG. 4 is a detailed depiction of another exemplary embodiment of the present invention. FIG. 4 shows a TSI 27 with an internal electrode 25 that is placed coaxially within the external electrode 28. The space between the electrodes 25 and 28 is substantially filled with an insulating material 23 (e.g., ceramic). The main distinguishing feature for the embodiment of FIG. 4 relative to that of FIG. 2 is that there is a flat, disk-shaped (circular) electrode surface 26 formed integrally with or attached to the free end of the center electrode 25, extending transversely to the longitudinal axis of electrode 25 and facing electrode 28. Note further that the horizontal plane of disk 26 is parallel to the associated piston head (not shown) when the plasma ignitor 27 is installed in an engine cylinder. The end surface of electrode 28 which faces electrode 26 also is a substantially flat circular shape extending parallel to the facing surface of electrode 26. As a result, an annular cavity 29 is formed between opposing surfaces of electrodes 26 and 28. More precisely, there are two substantially parallel surfaces of electrodes 26 and 28 spaced apart and oriented to be parallel to the top of an associated piston head, in contrast to the exemplary embodiment of FIG. 2 wherein the electrodes run perpendicularly to an associated piston head when in use. Consider that when the air/fuel mixture is ignited, the associated piston "rises" and is close to the spark plug or ignitor 27, so that it is preferably further from gap 29 of the ignitor 27 to the wall of the associated cylinder than to the piston head. Accordingly, the preferred direction for the plasma to travel to obtain maximum interaction with the mixture is from the gap 29 to the cylinder wall. The essentially parallel electrodes 26 and 28 are substantially parallel to the longest dimension of the volume of the combustible mixture at the moment of ignition, instead of being oriented perpendicularly to this dimension and toward the piston head as in the embodiment of FIG. 2, and the prior art. It was discovered that when the same electrical conditions are used for energizing ignitors 17 and 27, the plasma acceleration lengths l and L, respectively, are substantially equal for obtaining optimal plasma production. Also, for TSI 27, under these conditions the following dimensions work well: the radius of the disk electrode 26 is $R_2$=6.8 mm, the radius of the isolating ceramic is $R_1$=4.3 mm, the gap between the electrodes $g_2$=1.2 mm and the length L=2.5 mm.

In the embodiment of FIG. 4, the plasma 32 initiates in discharge gap 29 at the exposed surface of insulator 25, and grows and expands outwardly in the radial direction of arrows 29A.

Figure 5:
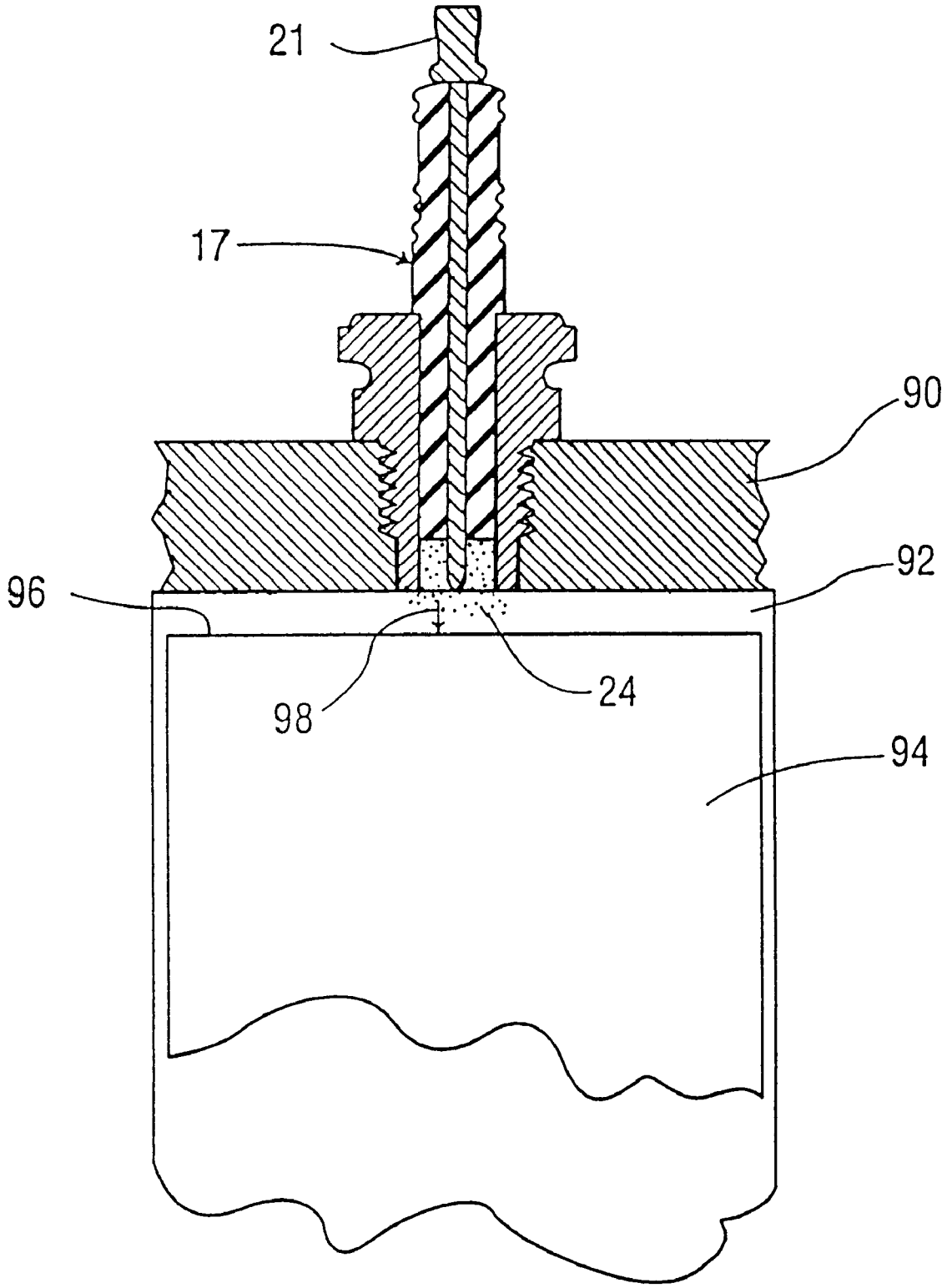
FIG. 5 is a cutaway pictorial view of a traveling spark ignitor for one embodiment of the invention, as installed into a cylinder of an engine.
Figure 6:
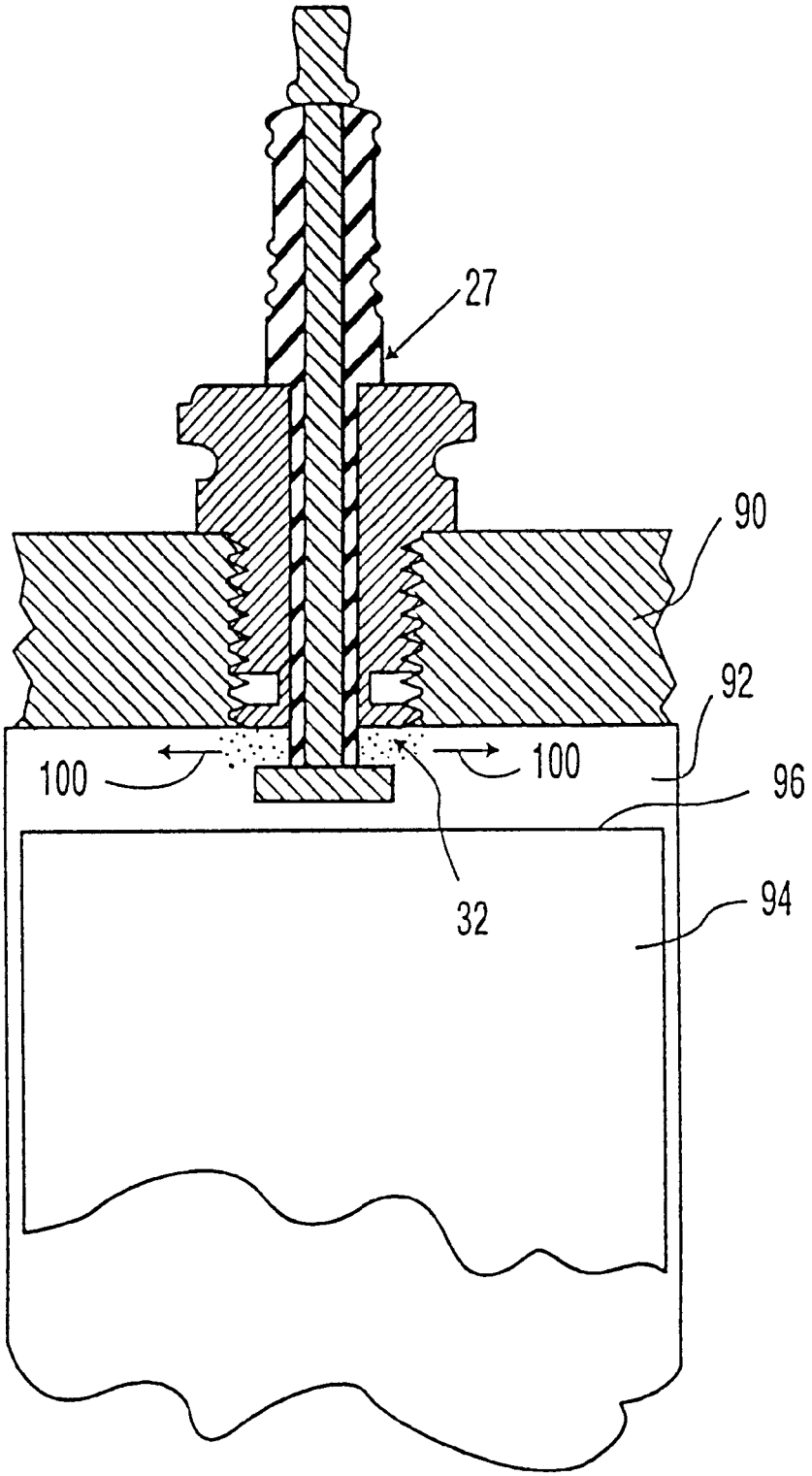
FIG. 6 is a cutaway pictorial view of a traveling spark ignitor for a second embodiment of the invention, as installed into a cylinder of an engine.

FIGS. 5 and 6 illustrate pictorially the differences in plasma trajectories between TSI 17 of FIG. 2, and TSI 27 of FIG. 4 when installed in an engine. In FIG. 5, a TSI 17 is mounted in a cylinder head 90, associated with a cylinder 92 and a piston 94 which is reciprocating—i.e., moving up and down—in the cylinder 92. As in any conventional internal combustion engine, as the piston head 96 nears top dead center, the TSI 17 will be energized. This will produce the plasma 24, which will travel in the direction of arrow 98 only a short distance toward or to the piston head 96. During this travel, the plasma 24 will ignite the air/fuel mixture (not shown) in the cylinder 92. The ignition begins in the vicinity of the plasma 24. In contrast to such travel of plasma 24, the TSI 27, as shown in FIG. 6, provides for the plasma 32 to travel in the direction of arrows 100, resulting in the ignition of a greater amount of air/fuel mixture than provided by TSI 17, as previously explained.

Figure 7:
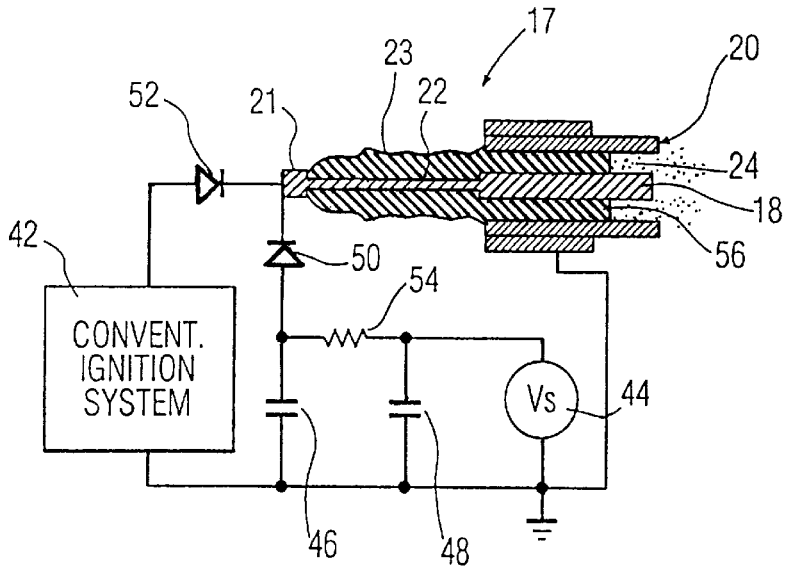
FIG. 7 is an illustration of the ignitor embodiment of FIG. 2 coupled to a schematic diagram of an exemplary electrical ignition circuit to operate the ignitor, according to an embodiment of the invention.

FIG. 7 shows TSI 17 with a schematic of the basic elements of an electrical or electronic ignition circuit connected thereto, which supplies the voltage and current for the discharge (plasma). (The same circuitry and circuit elements may be used for driving any embodiment of a TSI disclosed herein or later discovered.) A discharge between the two electrodes 18 and 20 starts along the surface 56 of the insulator material 22. The gas air/fuel mixture) is ionized by the discharge, creating a plasma 24 which becomes a good conductor of current and permits current between the electrodes at a lower voltage than that which initiated the plasma. This current ionizes more gas (air/fuel mixture) and increases the volume of the plasma 24.

The electrical circuit shown in FIG. 7 includes a conventional ignition system 42 (e.g., capacitive discharge ignition, CDI, or transistorized coil ignition, TCI), a low voltage ($V_s$) supply 44, capacitors 46 and 48 diodes 50 and 52, and a resistor 54. The conventional ignition system 42 provides the high voltage necessary to break down, or ionize, the air/fuel mixture in the gap along the surface 56 of the TSI 17. Once the conducting path has been established, the capacitor 46 quickly discharges through diode 50, providing a high power input, or current, into the plasma 24. The diodes 50 and 52 are necessary to isolate electrically the ignition coil (not shown) of the conventional ignition system 42 from the relatively large capacitor 46 (between 1 and 4 $\mu$F). If the diodes 50, 52 were not present, the coil would not be able to produce a high voltage, due to the low impedance provided by capacitor 46. The coil would instead charge the capacitor 46. The function of the resistor 54, the capacitor 48, and the voltage source 44 is to recharge the capacitor 46 after a discharge cycle. The use of resistor 54 is one way to prevent a low resistance current path between the voltage source 44 and the spark gap of TSI 17.

Note that the circuit of FIG. 7 is simplified, for purposes of illustration. In a commercial application, the circuit of FIG. 8 described below is preferred for recharging capacitor 46 in a more energy-efficient manner, using a resonant circuit. Furthermore, the conventional ignition system 42, whose sole purpose is to create the initial breakdown, is modified so as to use less energy and to discharge more quickly than has been conventional. Almost all of the ignition energy is supplied by capacitor 46. The modification is primarily to reduce high voltage coil inductance by the use of fewer secondary turns. This is possible because the initiating discharge can be of a much lower voltage when the discharge occurs over an insulator surface. The voltage required can be about one-third that required to cause a gaseous breakdown in air.

Figure 8:
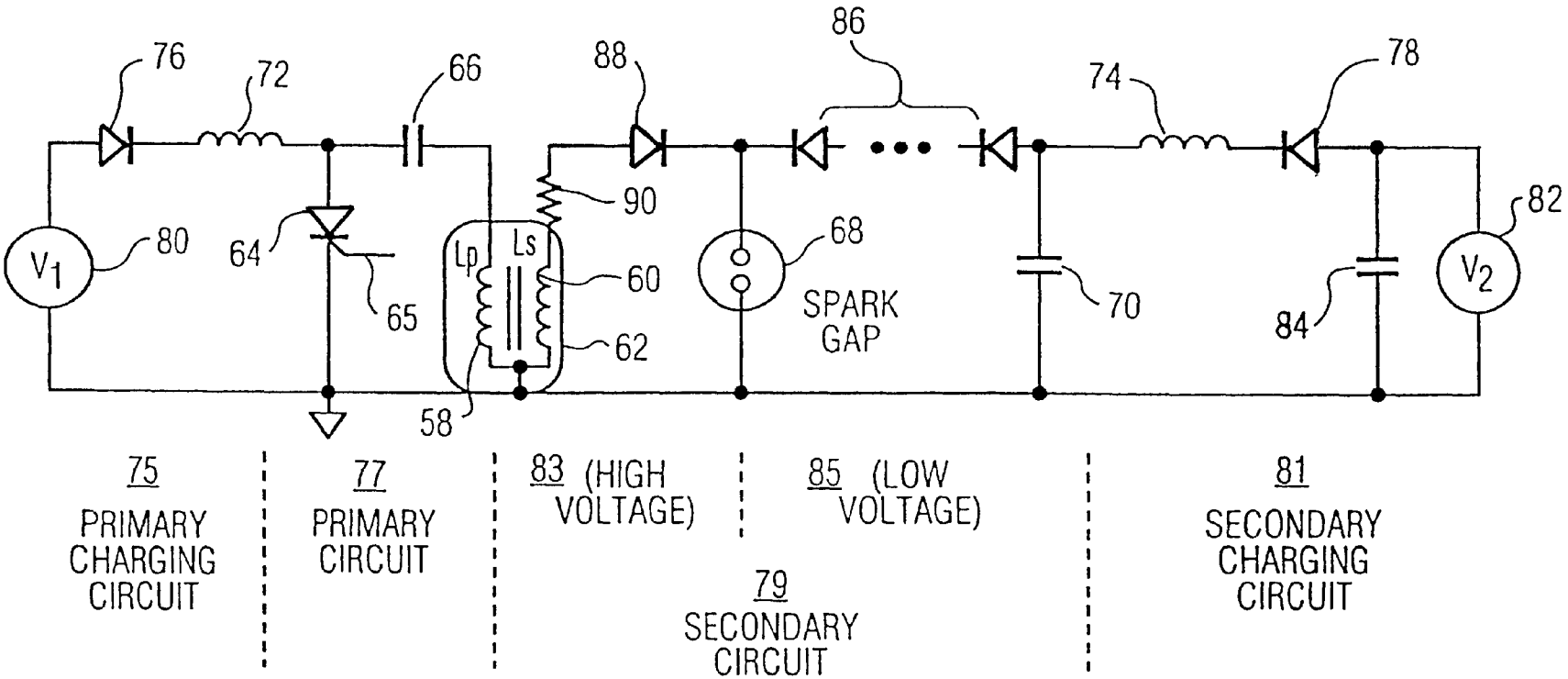
FIG. 8 shows a circuit schematic diagram of another ignition circuit embodiment according to the invention.

FIG. 8 shows a circuit schematic diagram of another ignition circuit embodiment according to the invention. Any embodiment of a TSI either herein disclosed or later discovered can be combined with the ignition electronics shown in FIG. 8 Matching the electronic circuit to the parameters of the plasma gun (length of electrodes, diameters of coaxial cylinders, duration of the discharge) maximizes the volume of the plasma when it leaves the gun for a given store of electrical energy. By properly choosing the parameters of the electronic circuit it is possible to obtain current and voltage time profiles so that substantially maximum electrical energy is transferred to the plasma.

The ignition electronics can be divided into four parts, as shown: the primary and secondary circuits 77, 79, respectively, and their associated charging circuits 75, 81, respectively. The secondary circuit 79, in turn, is divided into a high voltage section 83, and a low voltage section 85.

The primary and secondary circuits, 77 and 79, respectively, correspond to primary 58 and secondary 60 windings of an ignition coil 62. When the SCR 64 is turned on via application of a trigger signal to its gate 65, the capacitor 66 discharges through the SCR 64, which causes a current in the coil primary winding 58. This in turn imparts a high voltage across the associated secondary winding 60, which causes the gas in the spark gap 68 to break down and form a conductive path, i.e. a plasma. Once the plasma has been created, diodes 86 turn on and the secondary capacitor 70 discharges. The spark gap symbol 68 is representative of an ignitor, according to the invention, such as exemplary TSI devices 17 and 27 of FIGS. 2 and 4, respectively.

After the primary and secondary capacitors 66 and 70 have discharged, they are recharged by their respective charging circuits 75 and 81. Both charging circuits 75, 81 incorporate an inductor 72, 74 (respectively) and a diode 76, 78 (respectively), together with a power supply 80, 82 (respectively). The function of the inductor 72, 74 is to prevent the power supplies from being short-circuited through the ignitor. The function of the diodes 76 and 78 is to avoid oscillations. The capacitor 84 prevents the power supply 82 voltage $V_2$ from the going through large fluctuations.

The power supplies 80 and 82 both supply on the order of 500 volts or less for voltages $V_1$ and $V_2$, respectively. They could be combined into one power supply. (In experiments conducted by the inventors these power supplies were kept separate to make it easier to vary the two voltages independently.) Power supplies 80 and 82 may be DC-to-DC converters from a CDI (capacitive discharge ignition) system, which can be powered, for example, by a 12-volt car battery.

An essential part of the ignition circuit of FIG. 8 are one or more high current diodes 86, which have a high reverse breakdown voltage, larger than the maximum spark gap breakdown voltage of either TSI 17 or TSI 27, for all engine operating conditions. The function of the diodes 86 is to isolate the secondary capacitor 70 from the ignition coil 62, by blocking current from secondary winding 60 to capacitor 70. If this isolation were not present, the secondary voltage of ignition coil 62 would charge the secondary capacitor 70, and, given a large capacitance, the ignition coil 62 would never be able to develop a sufficiently high voltage to break down the air/fuel mixture in spark gap 68.

Diode 88 prevents capacitor 70 from discharging through the secondary winding 60 when there is no spark or plasma. Finally, the optional resistor 90 may be used to reduce current through secondary winding 60, thereby reducing electromagnetic radiation (radio noise) emitted by the circuit.

In the present TSI system, a trigger electrode can be added between the inner and outer electrodes of FIGS. 2 through 4 to lower the voltage on capacitor 70 in FIG. 8. Such a three electrode ignitor is shown in FIG. 9, and is described in the following paragraph.

Figure 9:
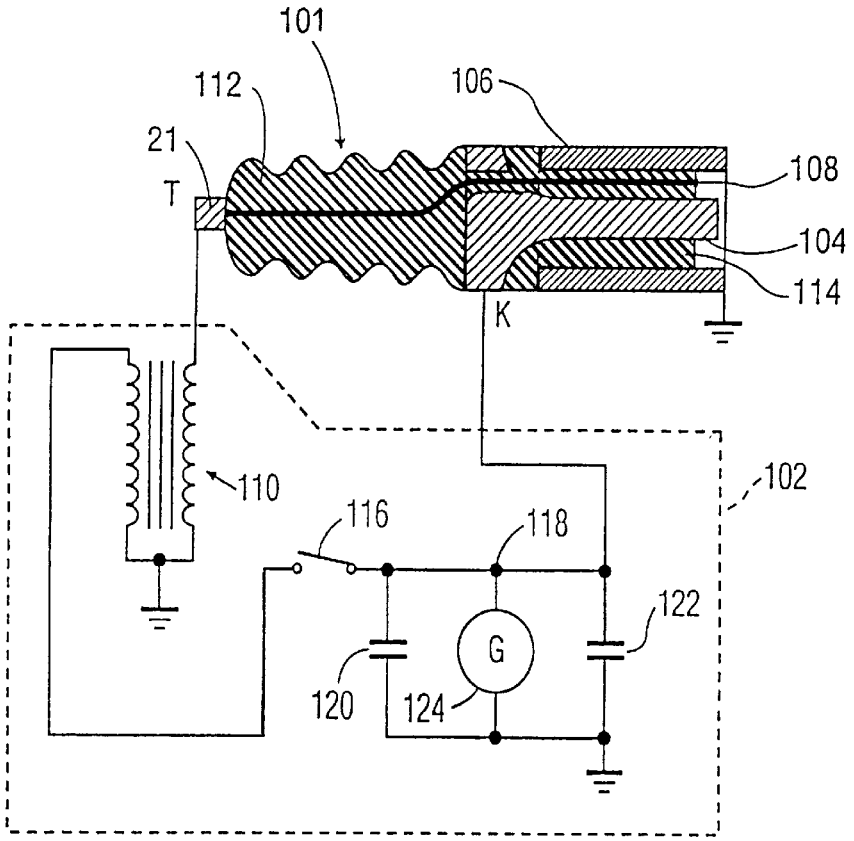
FIG. 9 shows a cross-sectional view of yet another traveling spark ignitor and exemplary electrical ignition circuit for an embodiment of the invention.

In FIG. 9, a three electrode plasma ignitor 101 is shown schematically. An internal electrode 104 is placed coaxially within the external electrode 106, both having diameters on the order of several millimeters. Radially between the internal electrode 104 and the external 106 is a third electrode 108. This third electrode 108 is connected to a high voltage (HV) coil 110. The third electrode 108 initiates a discharge between the two main electrodes 104 and 106 by charging the exposed surface 1 14 of the insulator 1 12. The space between all three electrodes 104, 106, 108 is filled with insulating material 112 (e.g., ceramic) except for the last 2–3 mm space between electrodes 104 and 106 at the combustion end of the ignitor 100. A discharge between the two main electrodes 104 and 106, after initiation by the third electrode 108, starts along the surface 114 of the insulator 112. The gas (air-fuel mixture) is ionized by the discharge. This discharge creates a plasma, which becomes a good electrical conductor and permits an increase in the magnitude of the current. The increased current ionizes more gas (air-fuel mixture) and increases the volume of the plasma, as previously explained.

The high voltage between the tip of the third electrode 108 and the external electrode 106 provides a very low current discharge, but which is sufficient to create enough charged particles on the surface 114 of the insulator 112 for the main capacitor to discharge between electrodes 104 and 106 along surface 104 of dielectric or insulator 112.

Figure 10A:
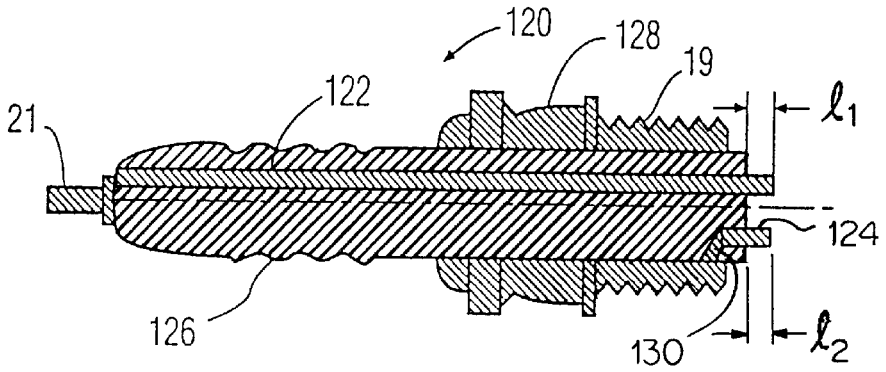
FIG. 10A shows a longitudinal cross-sectional view of another traveling spark ignitor for another embodiment of the invention.
Figure 10B:
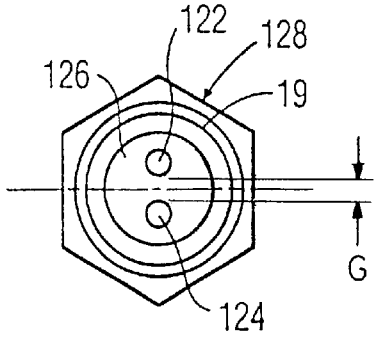
FIG. 10B is an end view of the traveling spark ignitor of FIG. 10A showing the free ends of opposing electrodes.
Figure 10C:
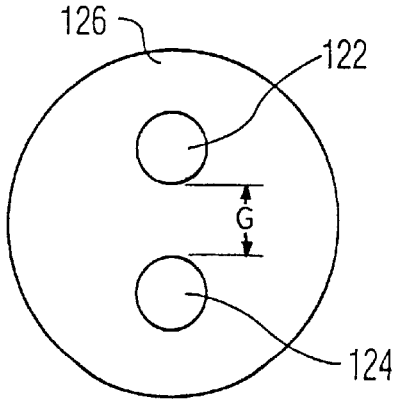
FIG. 10C is an enlarged view of a portion of FIG. 10B.

As shown in FIGS. 10A, 10B and 10C, another exemplary embodiment of the invention includes a traveling spark ignitor 120 having parallel rod-shaped electrodes 122 and 124, as shown. The parallel electrodes 122, 124 have a substantial portion of their respective lengths encapsulated by dielectric insulator material 126, as shown. A top end of the dielectric 126 retains a spark plug boot connector 21 that is both mechanically and electrically secured to the top end of electrode 122. The dielectric material 126 rigidly retains electrodes 122 and 124 in parallel, and a portion rigidly retains the outer metallic body 128 having mounting threads 19 about a lower portion, as shown. Electrode 124 is both mechanically and electrically secured to an inside wall of metallic body 128 via a rigid mount 130, as shown, in this example. As shown in FIG. 10A, each of the electrodes 122 and 124 extends a distance $l_1$ and $l_2$, respectively, outwardly from the surface of the bottom end of dielectric 126.

With reference to FIGS. 10B and 10C, the electrodes 122 and 124 are spaced apart a distance G, where G is understood to represent the gap between the electrodes 122, 124 (see FIG. 10C).

While various embodiments of the present invention have been described above, it should be understood that they have been presented by way of example only, and are not meant to be limiting. Thus, the breadth and the scope of the present invention are not limited by any of the above exemplary embodiments, but are defined only in accordance with the following claims and their equivalents.

What is claimed is:

1. A high efficiency plasma ignitor for an internal combustion engine, the engine having a combustion cylinder and means for delivering fuel to the combustion cylinder, the ignitor comprising:

at least two spaced apart electrodes, including at least a first electrode and a second electrode having a discharge gap between them, the first and second electrodes having a first length and a second length, respectively; and dielectric material filling a substantial portion, but not all, of said discharge gap between said first and second electrodes;

wherein the electrodes are dimensioned and configured and their spacing is arranged such that when the ignitor is mounted in the combustion cylinder of an engine and a sufficiently high first voltage is applied across the electrodes in a gaseous mixture of air and fuel in the combustion cylinder of the engine a plasma is generated from the gaseous mixture of fuel and air in the discharge gap, and the plasma moves outwardly into the cylinder from between the electrodes under both a thermal expansion force and a Lorentz force.

2. The plasma ignitor of claim 1, wherein a ratio of a width of the discharge gap to the length of one of the electrodes is greater than about one-third.

3. The plasma ignitor of claim 2, wherein the first and second electrodes are spaced apart parallel electrodes having a first and second radius, respectively.

4. The plasma ignitor of claim 3, wherein a ratio of the sum of radii of the electrodes to the length of one of the electrodes is greater than one-third and less than six and one-third.

5. The plasma ignitor of claim 1, wherein the first and second electrodes are concentric parallel cylinders, and wherein the first electrode has a first radius and the second electrode has a second radius.

6. The plasma ignitor of claim 5, wherein a ratio of the sum of radii of the electrodes to the length of one of the electrodes is greater than one-third and less than six and one-third.

7. The plasma ignitor of claim 3, wherein a ratio of the sum of radii of the electrodes to the length of one of the electrodes is greater than two and less than five.

8. The plasma ignitor of claim 7, further comprising mounting means matable with coacting mounting means in the combustion cylinder of the engine, such that the discharge gap of the plasma ignitor is disposed in the combustion cylinder when the ignitor mounting means are mated to the combustion cylinder's mounting means.

9. The plasma ignitor of claim 7, further comprising a third electrode located between the first and second electrodes.

10. The plasma ignitor of claim 7, wherein the lengths of the first and second electrodes are of the form of annular sections of disks oriented in a plane perpendicular to a longitudinal axis of the plasma ignitor.

11. The plasma ignitor of claim 5, wherein a ratio of the sum of radii of the electrodes to the length of one of the electrodes is greater than two and less than five.

12. The plasma ignitor of claim 11, further comprising a third electrode located between the first and second electrodes.

13. The plasma ignitor of claim 1, wherein the means for delivering fuel to the combustion cylinder provide the fuel the combustion cylinder by direct fuel injection.

14. A high efficiency traveling spark ignition system for an internal combustion engine, the engine having a combustion cylinder and means for delivering fuel to the combustion cylinder, the system comprising:

an ignitor including:

at least two spaced apart electrodes, including at least a first electrode and a second electrode having a discharge gap between them, the first and second electrode having a first length and a second length, respectively, the electrodes being spaced such that the ratio of the length of either electrode to a width of the discharge gap is greater than about one third;

dielectric material filling a substantial portion, but not all, of said discharge gap between said first and second electrodes, an unfilled portion of the discharge gap being an area for plasma formation the width of the discharge gap being measured anywhere in the unfilled portion;

means for mounting the mounting the ignitor such that the unfilled portion of the discharge gap is exposed to a gaseous mixture air and fuel contained in the combustion cylinder of the internal combustion engine; and electrical means for alternately providing a first and second potential difference between the first and second electrodes, the first potential difference creating a plasma in the unfilled portion of the discharge gap, the second potential sustaining a current through the plasma in the unfilled portion of the discharge gap, whereby a magnetic field from the current interacts with an electric field from the potential difference between the electrodes causing the plasma to be expelled from the discharge gap under both a Lorentz force and a thermal expansion force due to the creation of the plasma.

15. The system of claim 14 wherein the first and second electrodes are concentric parallel cylinders and have first and second radii, respectively.

16. The system of claim 15, wherein a ratio of the sum of radii of the electrodes to the length of one of the electrodes is greater than one-third and less than six and one-third.

17. The plasma ignitor of claim 15, wherein a ratio of the sum of radii of the electrodes to the length of one of the electrodes is greater than two and less than five.

18. The plasma ignitor of claim 17, further comprising a third concentric parallel electrode located between the first and second electrodes.

19. The system of claim 17, wherein the means for delivering fuel to the combustion cylinder deliver the fuel by direct fuel injection.

20. The system of claim 14, wherein the first and second electrodes are spaced apart parallel electrodes and have first and second radii, respectively.

21. The system of claim 20, wherein a ratio of the sum of radii of the electrodes to the length of one of the electrodes is greater than one-third and less than six and one-third.

22. The system of claim 20, wherein a ratio of the sum of radii of the electrodes to the length of one of the electrodes is greater than two and less than five.

23. The plasma ignitor of claim 22, further comprising a third spaced apart parallel electrode located between the first and second electrodes.

24. The system of claim 22, wherein the means for delivering fuel to the combustion cylinder deliver the fuel by direct fuel injection.

25. The plasma ignitor of claim 14, further comprising a third electrode located between the first and second electrodes.

26. The system of claim 14, wherein the means for delivering fuel to the combustion cylinder deliver the fuel by direct fuel injection.

* * * * *